US007588045B2

(12) United States Patent
Goodwin et al.

(10) Patent No.: US 7,588,045 B2
(45) Date of Patent: Sep. 15, 2009

(54) COLLAPSIBLE STRUCTURE WITH DOOR MECHANISM

(75) Inventors: Dianne M. Goodwin, St. Paul, MN (US); Sherry M. Rovig, Duluth, MN (US); Kevin B. Kinney, Duluth, MN (US)

(73) Assignee: Blue Sky Designs, Inc., St. Paul, MN (US)

( * ) Notice: Subject to any disclaimer, the term of this patent is extended or adjusted under 35 U.S.C. 154(b) by 405 days.

(21) Appl. No.: 10/643,333

(22) Filed: Aug. 19, 2003

(65) Prior Publication Data

US 2005/0055893 A1 Mar. 17, 2005

(51) Int. Cl.
*E04H 15/58* (2006.01)

(52) U.S. Cl. ..... 135/117; 135/120.3

(58) Field of Classification Search ..... 135/117, 135/120.3; 160/123; 49/347, 324, 445, 360, 49/404, 409, 411, 372, 373; 52/79.5, 79.8
See application file for complete search history.

(56) References Cited

U.S. PATENT DOCUMENTS

| | | | | |
|---|---|---|---|---|
| 3,328,105 | A * | 6/1967 | Trulaske | 49/445 |
| 4,858,635 | A | 8/1989 | Eppenbach | |
| 5,579,799 | A * | 12/1996 | Zheng | 135/126 |
| 5,765,584 | A | 6/1998 | Heisler et al. | |
| 6,155,326 | A * | 12/2000 | Imhoff et al. | 160/243 |
| 6,296,003 | B1 | 10/2001 | Howe et al. | |
| 6,484,739 | B1 * | 11/2002 | Sofie et al. | 135/117 |
| 6,499,497 | B1 | 12/2002 | Swetish et al. | |
| 6,532,699 | B1 * | 3/2003 | Franklin et al. | 52/29 |

* cited by examiner

*Primary Examiner*—Basil Katcheves
(74) *Attorney, Agent, or Firm*—Crompton, Seager & Tufte LLC

(57) ABSTRACT

Door mechanisms for simplified and unobstructed passage through an entranceway of a collapsible structure are disclosed. The door mechanism may include a fanning, swinging or sliding door configured to move between an open position and a closed position within the entranceway. The door mechanism may include a fastener to secure the door to the structure or to an adjacent door. The door mechanism may be provided as part of a stand-alone structure, or as a part of a structure adapted for use with other adjacent structures.

4 Claims, 14 Drawing Sheets

COLLAPSIBLE STRUCTURE WITH DOOR MECHANISM

FIELD OF THE INVENTION

The present invention relates generally to the field of collapsible structures. More specifically, the present invention pertains to door mechanisms for simplified and unobstructed passage through the entranceway of a collapsible structure.

BACKGROUND OF THE INVENTION

Collapsible structures such as vestibules and tents are useful in a wide variety of applications for providing shelter and storage from the elements. Vestibules, for example, are frequently used in outdoor applications for sheltering and storing personal belongings, backpacks, cooking utensils, mobility devices, etc. from elements such as wind or moisture. These structures are generally available as either a stand-alone model for use independent of another structure, or as an adaptive structure configured to attach to an adjacent vehicle or structure. In certain models, the vestibules may have a modularizing feature that permits multiple structures to be attached together.

Entry into the collapsible structure is generally accomplished through an entranceway suitably dimensioned to permit access into or out of the interior of the structure. A door, panel, flap, screen, or other door mechanism equipped with a zipper, Velcro®, snap-fitting or other fastening means may be employed to seal the structure from the outside, or to block access to other connected structures (e.g. an adjacent vestibule, tent or vehicle). In some designs, the wall containing the entranceway may include a number of support members that provide additional strength for the collapsible structure. The collapsible structure may include, for example, several vertically oriented poles positioned along the wall containing the entranceway to prevent the wall from sagging or bowing from the weight supported above. In some designs, a raised lip or lower doorway edge is also employed to laterally tension the collapsible structure to reduce swaying or other horizontal motion that can affect the structural integrity of the structure.

Access through conventional door mechanisms can often prove difficult, particularly for individuals confined to a wheelchair, stroller, or other mobility device. The zipper, Velcro® or snap-fitting fasteners used by many prior art devices to seal the door mechanism are difficult and, in some cases impossible, to operate for those individuals who lack the manual dexterity to activate the fastener. In those designs employing a zipper, for example, the user must be capable of reaching along the entire perimeter of the entranceway to zip and/or unzip the zipper. This may pose a significant hardship for individuals confined to a mobility device since certain areas along the path of the zipper may be beyond the individual's reach. Moreover, the support members used to provide vertical and lateral support to the structure may, in certain cases, interfere with the wheels or feet of the mobility device as it enters or exits through the entranceway. As a result, there is a need in the art for a door mechanism that permits simplified and unobstructed passage through the entranceway of a collapsible structure.

SUMMARY OF THE INVENTION

The present invention pertains to door mechanisms for simplified and unobstructed passage through the entranceway of a collapsible structure. In one exemplary embodiment, a door mechanism adapted to fit within an entranceway of the collapsible structure may be configured to move between an open position and a closed position. The door mechanism may comprise a door formed from a flexible material, and may include one or more reinforcement members that support and provide shape to the door. The door mechanism can be ergonomically designed to permit simplified and unobstructed passage through the entranceway of the collapsible structure, reducing the amount of dexterity required to operate the door. The door mechanism can be utilized in either a stand-alone collapsible structure, or in an adaptive structure for use with a vehicle, tent, or other adjacent structure.

In one exemplary embodiment, the door mechanism may include a fan-shaped door constructed from a flexible material adapted to fold upon itself and away from the entranceway. The fan-shaped door may include a number of reinforcement members that provide structural support to the door. An attachment joint operatively coupled to at least one of the reinforcement members may be used to pivotally secure the members to the structure, allowing the fan-shaped door to fan between an open position and a closed position. In some embodiments, a hook, clip, clamp, pole or other suitable fastener may be utilized to secure the door to the structure once closed.

In another exemplary embodiment, the door mechanism may comprise one or more swinging or café-style doors configured to move between an open position and a closed position. A closure mechanism operatively coupled to each door may be configured to automatically close the doors during periods of nonuse. The closure mechanism may include, for example, a flexible cable or cord operatively coupled at one end to the door and at the other end to a counterweight. The flexible cable or cord may be threaded through a number of eyelets or pulleys that allow the counterweight to pull the doors shut in the absence of a sufficient force applied thereto. In some embodiments, a fastener can be used to secure the doors together once closed.

In another exemplary embodiment, the door mechanism may comprise a sliding door adapted to retract within a double-layered wall of the collapsible structure. The sliding door may be configured to slide along, for example, a guiding member such as a mesh strap that extends laterally across the bottom portion of the entranceway. The sliding door may be releasably secured to the guiding member using, for example, a retaining strap equipped with a snap fitting. In some embodiments, an optional threshold located along the bottom portion of the entranceway may also be utilized to guide the door as it is moved from an open position to a closed position.

DETAILED DESCRIPTION OF THE INVENTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

As indicated above, the present invention is directed generally to an ergonomically designed door mechanism that provides simplified and unobstructed passage through an entranceway of a collapsible structure. While the various embodiments depicted herein are described specifically with respect to door mechanisms for vestibules, it should be understood the present invention is intended for use in a wide variety of structures including, but not limited to, tents, gazebos, screen-porches, domes, ice-houses, sunshades/wind blocks, canopies, cabanas, yurts, or the like.

Figure 1:
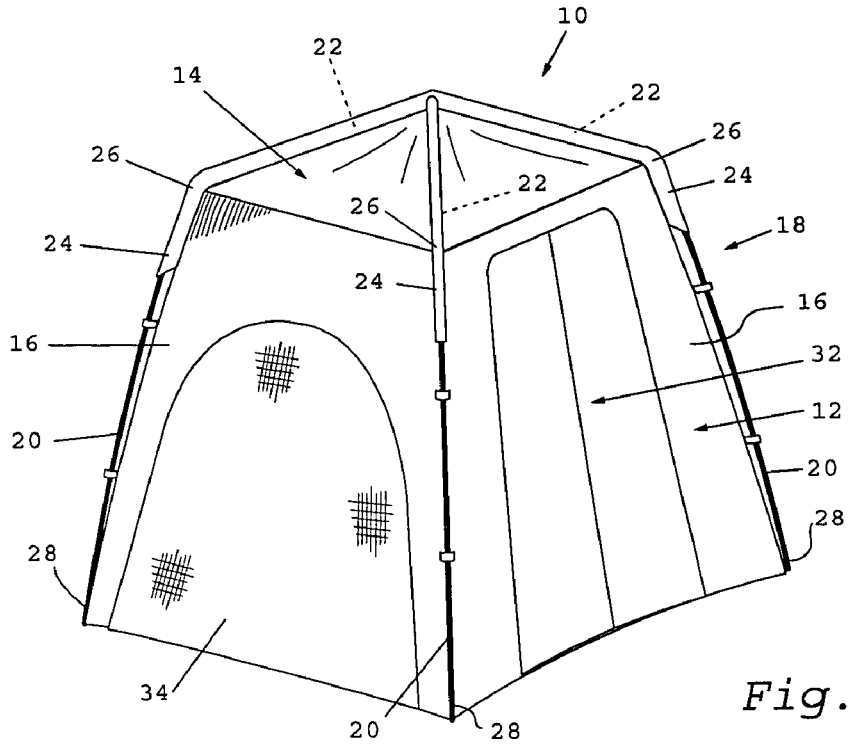
FIG. 1 is a perspective view of an illustrative collapsible structure in accordance with an exemplary embodiment of the present invention.

Referring now to FIG. 1, a collapsible structure 10 employing a door mechanism 12 in accordance with an exemplary embodiment of the present invention will now be described. Collapsible structure 10, illustratively a vestibule, includes a roof structure 14 and a number of walls 16. The roof structure 14 and walls 16 of the collapsible structure 10 are formed from a flexible material that can be easily stretched to assume a particular shape with the aid of a collapsible support frame 18. For example, the roof structure 14 and walls 16 can be made from Nylon, plastic tarpaulin, or other lightweight material commonly used in the construction of tents or the like. In certain embodiments, the roof structure 14 and walls 16 may be made from silicon impregnated Nylon, which is relatively lightweight and breathable, and which provides excellent resistance to moisture. The materials used in forming the roof structure 14 and walls 16 can be selected for their ability to easily fold and collapse into a protective bag or other storage means. Other factors such as durability, cost, opacity, weight, and ease of manufacturing may also be considered in the selection of materials used to construct the roof structure 14 and walls 16.

The collapsible support frame 18 may include a number of vertical support members 20 and roof support members 22, which in combination provide support and shape to the roof structure 14 and walls 16. The roof support members 22 overlie and support the roof structure 14 from above, pitching the roof structure 14 in a slight upward slope. In use, the roof support members 22 provide additional lateral support for the collapsible structure 10, reducing swaying or shifting caused by wind or other external force. The vertical support members 20 may be attached to the roof support members 22 at a number of joints 26 disposed about the upper corners of the walls 16. From these joints 26, the vertical support members 20 extend downwardly to the bottom corners 28 of each wall 16. The vertical support members 20 can be secured to the collapsible structure 10 using, for example, a holster, pin, grommet, hook, or other suitable fastener.

In certain embodiments, the vertical support members 20 and roof support members 22 may each be formed from poles that can be bent or flexed slightly during assembly. The support members 20, 22 may comprise a lightweight material such as fiberglass, carbon fiber, polyvinylchloride (PVC), or aluminum. A number of sleeves 24 attached to the roof structure 14 and portions of the walls 16 may be configured to slidably receive the support members 20, 22 therein. The sleeves 24 may be sewn onto or otherwise attached to the material forming the roof structure 14 and walls 16, and function by holding the support members 20, 22 in place adjacent to the material.

The illustrative collapsible structure 10 depicted in FIG. 1 is configured for use as a stand-alone shelter for storing personal belongings or supplies, or for use as a common gathering place. The collapsible structure 10 may include an entranceway 32, which, as is discussed in greater detail below, may be equipped with a door mechanism 12 to facilitate passage through the entranceway 32 without requiring a zipper, Velcro®, snap-fitting, or other similar fastener typically employed to seal such structures. A screen door, window or other opening 34 located adjacent or opposite the wall containing the entranceway 32 may also be employed, if desired, to open the interior space of the structure 10 to the outside, or to permit access to an adjacent structure (not shown).

Figure 2:
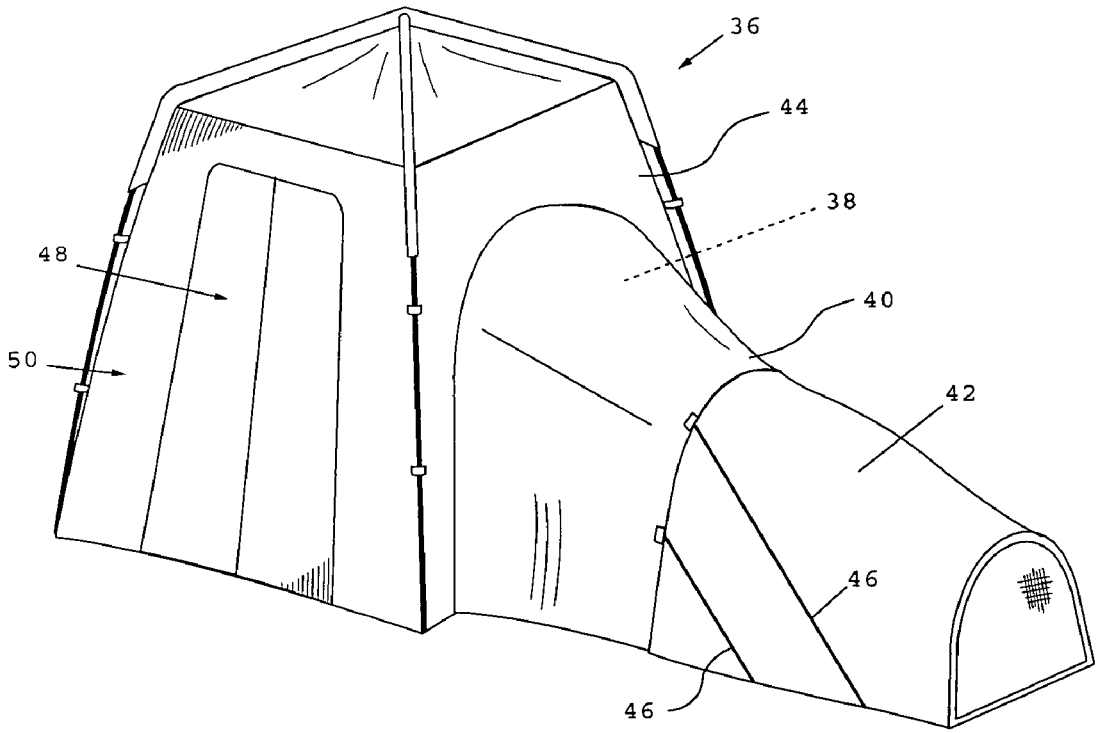
FIG. 2 is a perspective view showing another illustrative collapsible structure attached to a tent.
Figure 3:
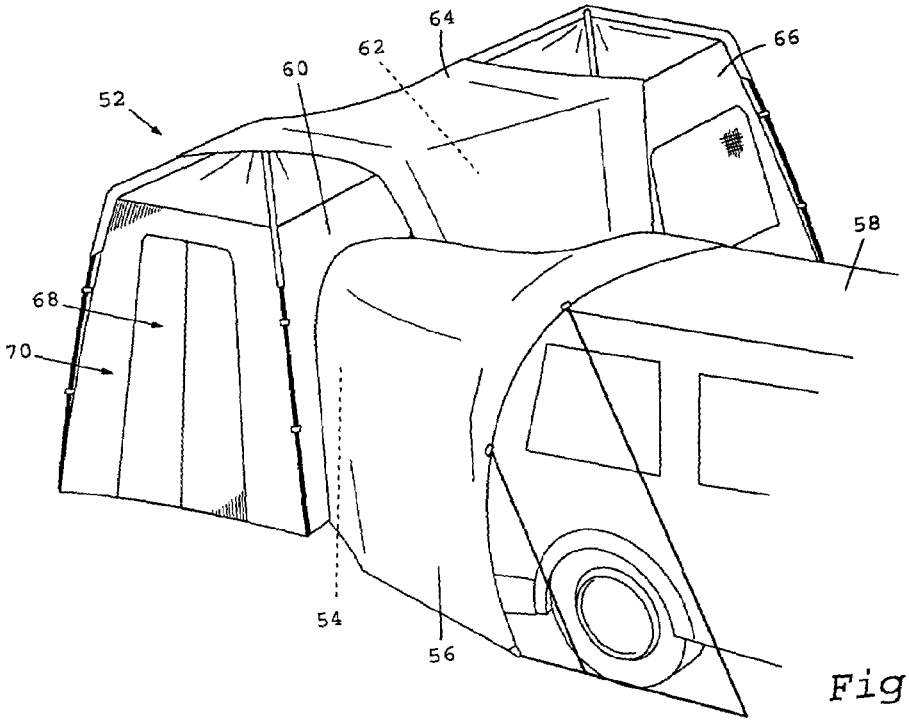
FIG. 3 is a perspective view showing another illustrative collapsible structure attached to a vehicle and other structure.
Figure 4:
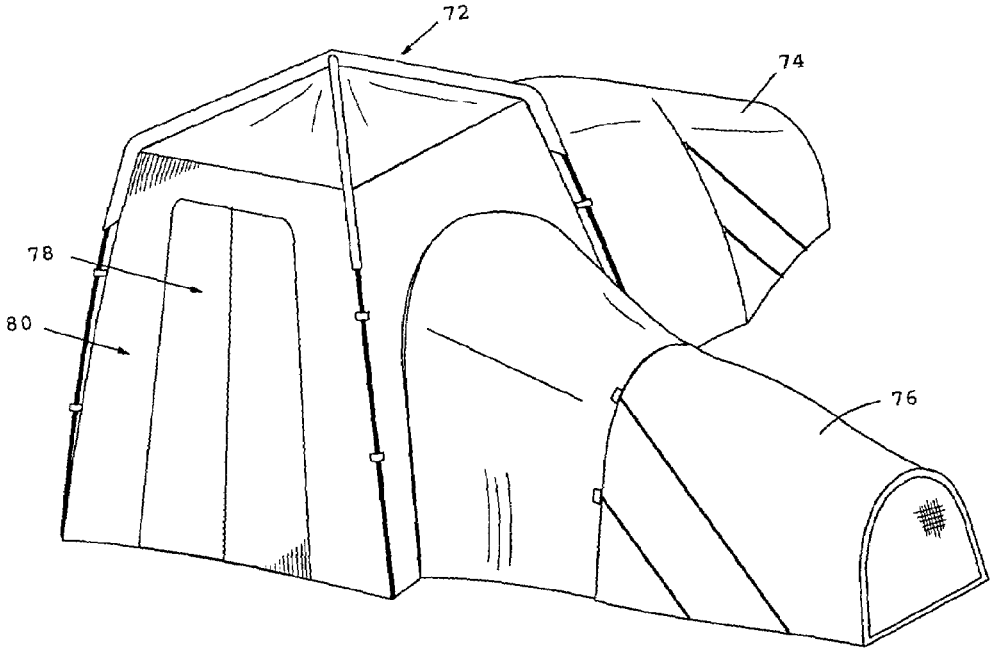
FIG. 4 is a perspective view showing another illustrative collapsible structure attached to a number of other structures.

FIGS. 2-4 illustrate variations of the collapsible structure 10 similar to that depicted in FIG. 1. In FIG. 2, a collapsible structure 36 may include an opening 38 and fly 40 configured to attach to a single person tent 42 or other adjacent structure.

The fly 40 may be releasably secured to one of the walls 44 of the collapsible structure 36 using a suitable fastener that can be used to quickly attach/detach the fly 40 from the tent 42 and wall 44. One or more elastic cords 46 (e.g. bungee cords) configured to stretch and attach to the ground may be used to maintain the fly 40 taut against the tent 42.

An entranceway 48 equipped with a door mechanism 50 may be used to gain access to the interior of the collapsible structure 36 and attached tent 42. The door mechanism 50 may be configured to permit passage into the interior of the collapsible structure 36 without requiring the user to manually open or close the door mechanism with a zipper, Velcro® or other similar fastening mechanism, thus reducing the amount of dexterity necessary to pass through the entranceway 48.

FIG. 3 illustrates a collapsible structure 52 adapted for use with a vehicle such as a camper, van, car or truck. Collapsible structure 52 may include an opening 54 and fly 56 connecting the interior of the structure 52 to the rear hatch of, for example, an automobile 58. The fly 56 may be releasably secured to one of the walls 60 of the collapsible structure 52 with a suitable fastener (e.g. snap fittings), and may include one or more elastic cords that maintain the fly 56 taut against the automobile 58.

The collapsible structure 52 may further include a second opening 62 and fly 64 connecting the interior of the structure 52 to an adjacent structure 66 such as a vestibule or tent. Access to the adjacent structure 66 and automobile 58 may be obtained through an entranceway 68 equipped with a door mechanism 70 in accordance with the present invention. As with other embodiments described herein, the door mechanism 70 can be configured to permit passage into the interior of the collapsible structure 52 without requiring the user to manually open or close the door mechanism with a zipper, Velcro® or other similar fastening mechanism.

In certain embodiments, multiple structures may be coupled to the collapsible structure to form a modularized system of portable shelters. As depicted in FIG. 4, for example, a collapsible structure 72 may be connected to a number of other adjacent structures 74,76 (e.g. tents). Each adjacent structure may 74, 76, in turn, be further linked to other structures (not shown), if desired, to increase the amount of interior space within the system. The number and type of connected structure may, of course, vary depending on the user's needs. As with the other collapsible structure discussed herein, the collapsible structure 72 depicted in FIG. 4 may include an entranceway 78 equipped with a door mechanism 80 configured to permit simplified and unobstructed passage into or out of the structure 72.

Figure 5:
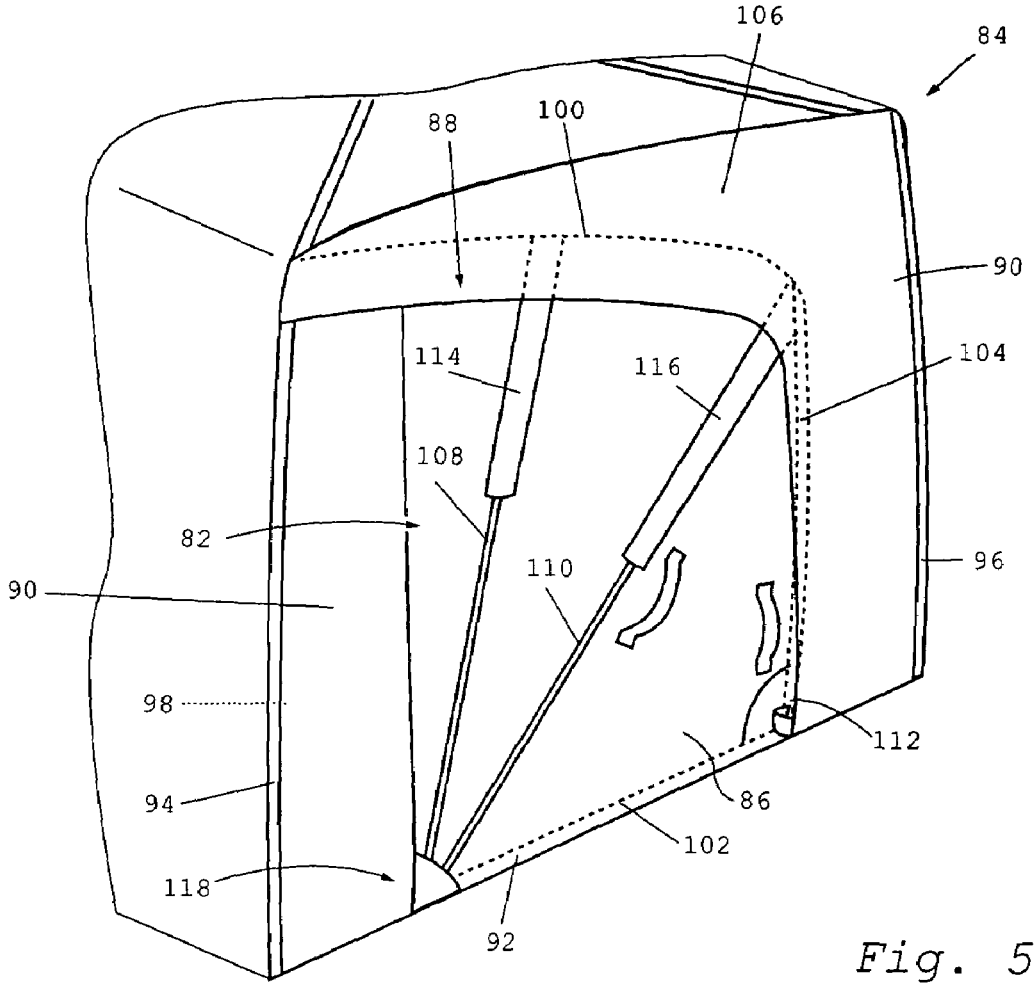
FIG. 5 is a fragmentary elevation view of a door mechanism for use with an illustrative collapsible structure.

Referring now to FIG. 5, an exemplary door mechanism 82 for use with an illustrative collapsible structure 84 may comprise a fan-shaped door 86 configured to fit contiguously within an entranceway 88 formed through one of the walls 90 of the structure 84. As indicated by dashed lines in FIG. 5, the entranceway 88 curves downwardly from left to right, defining an arch-shaped opening 174 (FIG. 17) located contiguously behind the fan-shaped door 86. A mesh strap 92 or other elongated member configured to lie flush with the ground or an optional floor spans the lower edge of the entranceway 88, providing lateral support for the wall 90. Two vertical support members 94, 96 provide vertical support for each side of the wall 90.

The fan-shaped door 86 may be formed from a flexible material that can be positioned across the entranceway 88 to provide a seal for the collapsible structure 84. In certain embodiments, the fan-shaped door 86 can be made from silicon impregnated Nylon, plastic tarpaulin, or other lightweight material, similar to that used in the construction of the roof structure 14 and walls 16 described above with respect to FIG. 1. Reinforced textile materials may also be utilized in the construction of the fan-shaped door 86, if desired. The particular materials used in the construction of the fan-shaped door 86 can be selected for its ability to withstand creasing when folded onto itself, allowing the fan-shaped door 86 to revert to the same shape each time the door 86 is closed.

The fan-shaped door 86 may have a shape that correlates generally with the shape of the entranceway 88, but of greater size to block access through the entranceway 88 when the door 86 is placed in the closed position. A left edge 98 of the fan-shaped door 86 is connected to the left side of the wall 90 at or near vertical support member 94. The upper, lower, and right edges 100, 102, 104 of the fan-shaped door 86, in turn, are unconstrained relative to the wall 90, allowing the door 86 to fan from left to right across the arch-shaped opening 174 to seal the entranceway 88.

A second layer of material 106 coupled to the wall 90 contiguous and in front of the fan-shaped door 86 acts as a guide, constraining movement of the door 86 in a plane substantially parallel to the plane of the wall 90. As shown in FIG. 5, the second layer of fabric 106 extends from the top left corner of the wall 90 and slopes downwardly and to the right, terminating at the lower right corner of the wall 90. In use, the second layer of fabric 106 forms a double-layered wall that receives the fan-shaped door 86 therein. The space between the two layers of fabric forms a guide channel for the fan-shaped door 86, and acts as a seal to prevent elements such as moisture and wind from entering the collapsible structure 84.

The fan-shaped door 86 may further include one or more reinforcement members, which provide structural support for the door 86. In the embodiment illustrated in FIG. 5, for example, the fan-shaped door 86 includes three reinforcement members 108, 110, 112 that together support the door 86 within the entranceway 88. In certain embodiments, the reinforcement members 108,110, 112 may comprise poles, rods, tubes, battens, wires or the like formed from a lightweight material such as fiberglass, carbon fiber, polyvinylchloride (PVC), or aluminum.

The first and second reinforcement members 108, 110 may each be connected to the fan-shaped door 86 via a number of respective sleeves 114, 116. Each sleeve 114, 116 may extend along only a portion of the length of the two reinforcement members 108, 110, allowing the members 108, 110 to be easily removed from within the sleeves 114, 116 during disassembly. The third reinforcement member 112 may be placed within a third sleeve (not shown) that extends along all or a portion of the right edge 104 of the fan-shaped door 86.

The first and second reinforcement members 108, 110 may be pivotally coupled at an attachment joint 118 located along the lower edge of the entranceway 88. The first and second reinforcement members 108, 110 converge at joint 118 to form a V-shaped support structure for the fan-shaped door 86. This V-shaped structure permits the upper, lower, and right edges 100, 102, 104 of the fan-shaped door 86 to pivot about the joint 118, allowing the user to move the door 86 between an open position and a closed position.

Figure 6:
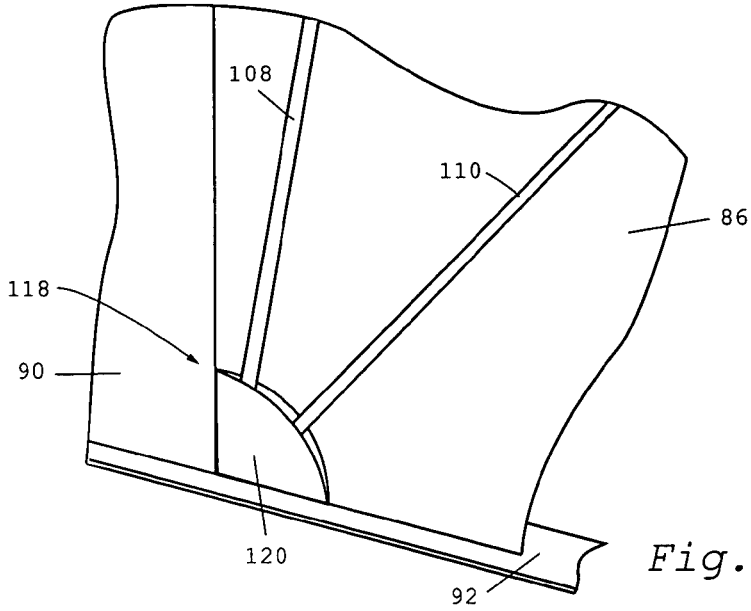
FIG. 6 is an exploded fragmentary elevation view showing an attachment joint in accordance with an exemplary embodiment of the present invention.

FIG. 6 is an enlarged fragmentary elevation view showing the connection of the first and second reinforcement members 108, 110 to the attachment joint 118. As shown in FIG. 6, the attachment joint 118 may comprise a flexible pocket 120 configured to retain the ends of the first and second reinforcement members 108, 110 therein. In certain embodiments, the flexible pocket 120 may be formed from a reinforced textile material that is sewn into the fan-shaped door 86 or, in the alternative, to the wall 90 or mesh strap 92. In use, the flexible pocket 120 pivotally secures the first and second reinforcement members 108, 110 to the structure 84, allowing the user to actuate the fan-shaped door 86 between an open position and a closed position.

Figure 7:
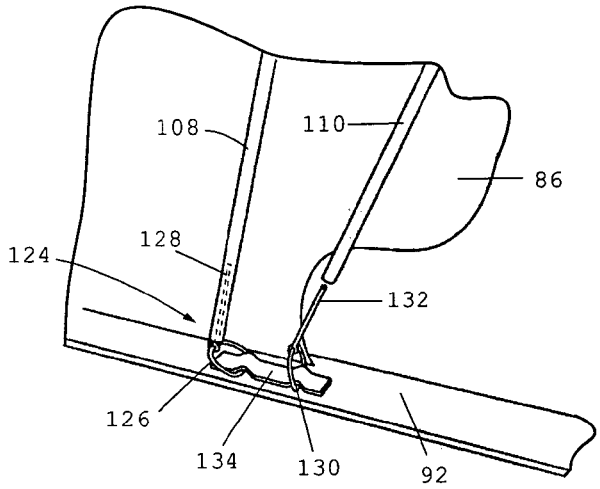
FIG. 7 is a fragmentary elevation view showing an attachment joint in accordance with another exemplary embodiment of the present invention.

FIG. 7 is a fragmentary elevation view of another exemplary attachment joint 124 configured to pivotally secure the first and second reinforcement members 108, 110 of FIG. 5 to the collapsible structure 84. Attachment joint 124 includes a first locking ring 126 having a first mounting post 128 (indicated by dashed lines) that can be inserted into the bottom end of the first reinforcement member 108. A second locking ring 130 having a second mounting post 132 (shown in FIG. 7 in a detached position) can be inserted into the bottom end of the second reinforcement member 110. The first and second locking rings 126, 130 may be coupled to the mesh strap 92 using a mounting bracket 134 or the like.

Figure 8:
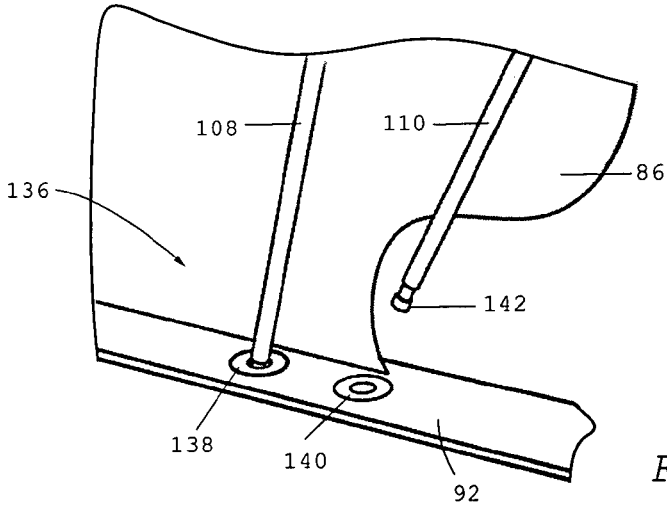
FIG. 8 is a fragmentary elevation view showing an attachment joint in accordance with another exemplary embodiment of the present invention.

FIG. 8 is a fragmentary elevation view of another exemplary attachment joint 136 configured to pivotally secure the first and second reinforcement members 108, 110 of FIG. 5 to the collapsible structure 84. Attachment joint 136 includes a first grommet 138 and second grommet 140, each disposed through a portion of the mesh strap 92. The first grommet 138 may be configured to receive a reduced diameter portion (not shown) on the bottom end of the first reinforcement member 108. The second grommet 140 may be similarly configured to receive a reduced diameter portion 142 on the bottom end of the second reinforcement member 110, which in FIG. 8 is shown removed from the second grommet 140 for sake of clarity. In use, the first and second grommets 138, 140 may be used to pivotally secure the reinforcement members 108, 110 to the collapsible structure 84.

Figure 9:
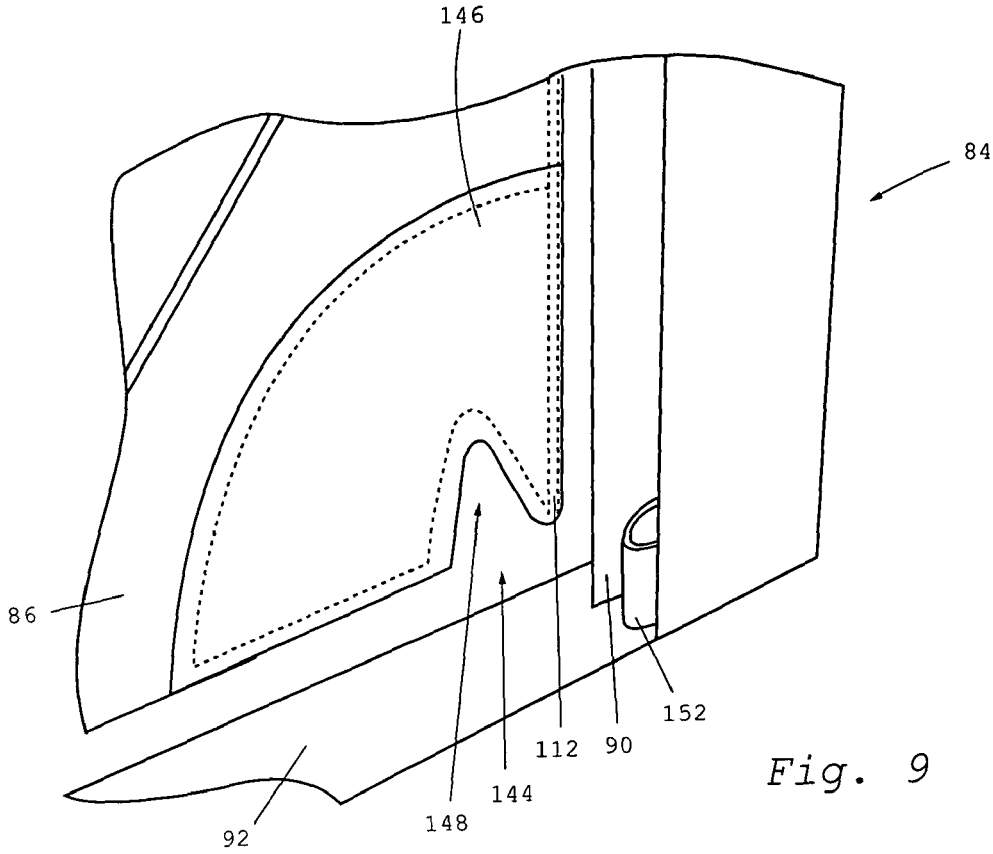
FIG. 9 is a fragmentary elevation view of an exemplary fastener used to secure the door to the collapsible structure.
Figure 10:
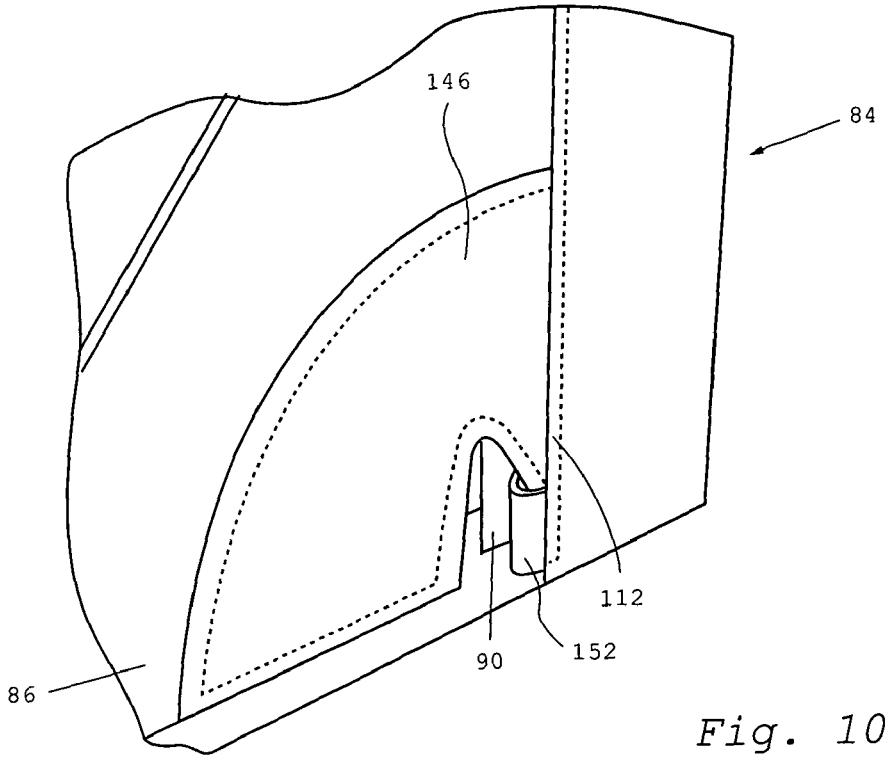
FIG. 10 is another fragmentary elevation view showing the fastener of FIG. 9 in an engaged position.

Referring now to FIGS. 9-10, an exemplary fastener 144 for securing the fan-shaped door 86 to the collapsible structure 84 will now be described. As shown in FIG. 9, fastener 144 may comprise a reinforced textile portion 146 attached to or formed integrally with the material forming the lower right portion of the fan-shaped door 86. An upwardly projecting indentation 148 in the reinforced textile portion 146 allows the third reinforcement member 112 to be inserted into a capture 152 attached to, for example, the wall 90 of the collapsible structure 84. To secure the fan-shaped door 86 to the collapsible structure 84, the user pulls the door 86 upwards and to the right a slight distance, causing the reinforcement member 112 to align with the capture 152. Once aligned, the reinforcement member 112 is then advanced downwardly and inserted into the capture 152, securing the fan-shaped door 86 to the collapsible structure 84, as shown in FIG. 10.

Figure 11:
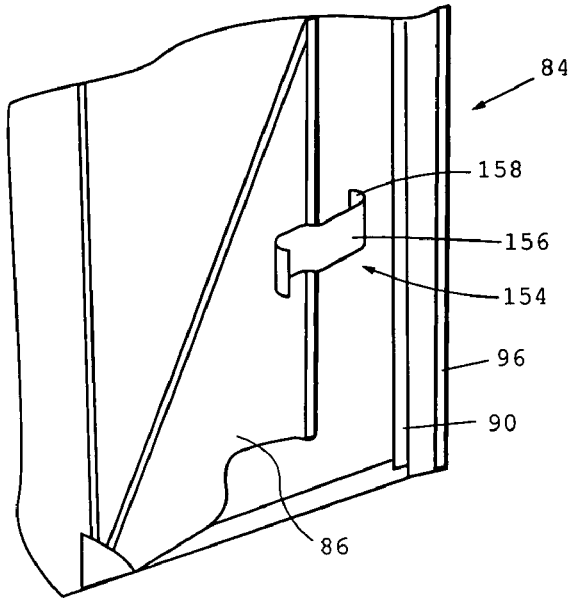
FIG. 11 is a fragmentary elevation view of a fastener in accordance with another exemplary embodiment of the present invention.

In an alternative embodiment depicted in FIG. 11, a fastener 154 suitable for securing the fan-shaped door 86 to the collapsible structure 84 may comprise a hook or clip member 156 configured to releasably secure to the vertical support member 96 supporting the right side of the wall 90. A curved portion 158 of the hook or clip member 156 may be dimensioned to tightly fit about and grip the vertical support member 96.

Figure 12:
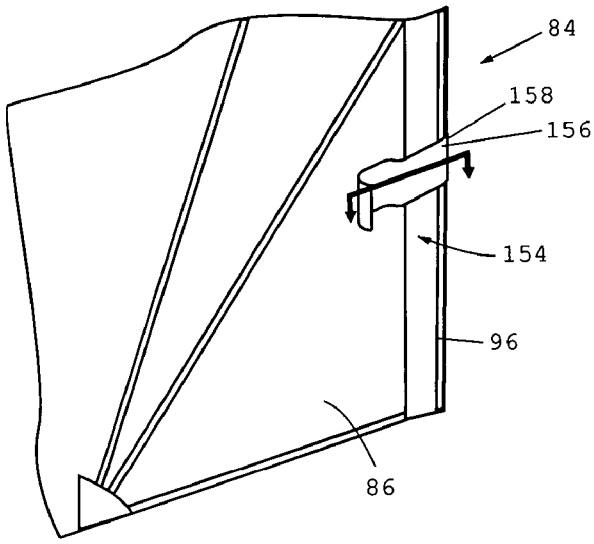
FIG. 12 is another fragmentary elevation view showing the fastener of FIG. 11 in an engaged position.
Figure 13:
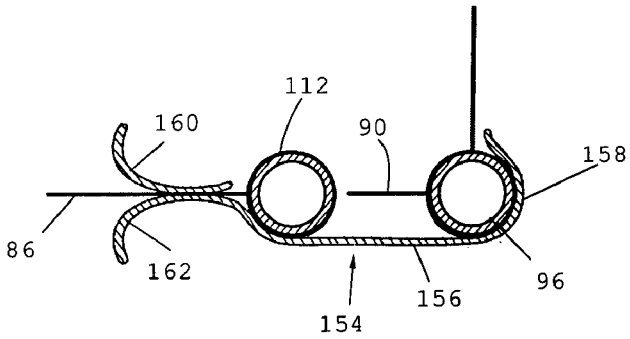
FIG. 13 is a cross-sectional view taken along line 13-13 illustrated in FIG. 12.

To secure the fan-shaped door 86 to the vertical support member 96, the user pulls the door 86 towards the support member 96 and downwardly a slight distance, causing the curved portion 158 of the hook or clip member 156 to engage the support member 96, as shown in FIG. 12. As can be seen in cross-section in FIG. 13, the curved portion 158 of hook or clip member 156 tightly grips the vertical support member 96, holding the fan-shaped door 86 in sealing engagement with the wall 90. The hook or clip member 156 can be disengaged from either outside or inside of the collapsible structure 84 by pulling the hook or clip member 156 away from the vertical support member 96 vis-à-vis handles 160, 162 located on both faces of the fan-shaped door 86.

Figure 14:
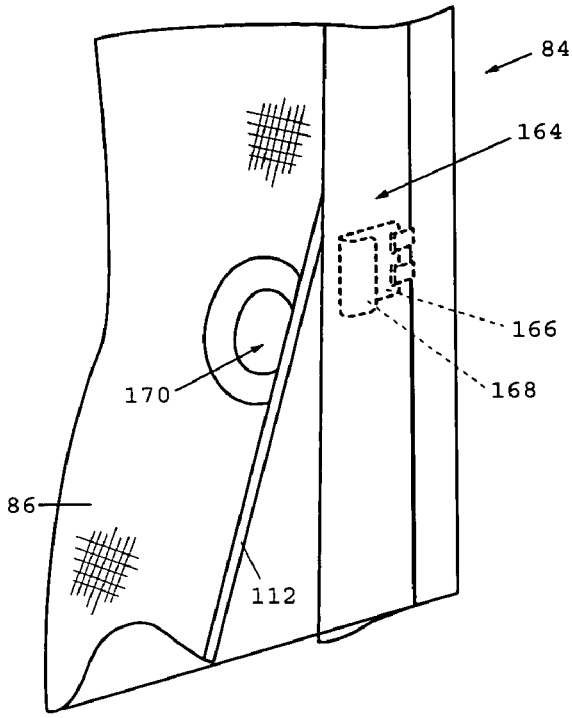
FIG. 14 is a fragmentary elevation view of a fastener in accordance with another exemplary embodiment of the present invention.
Figure 15:
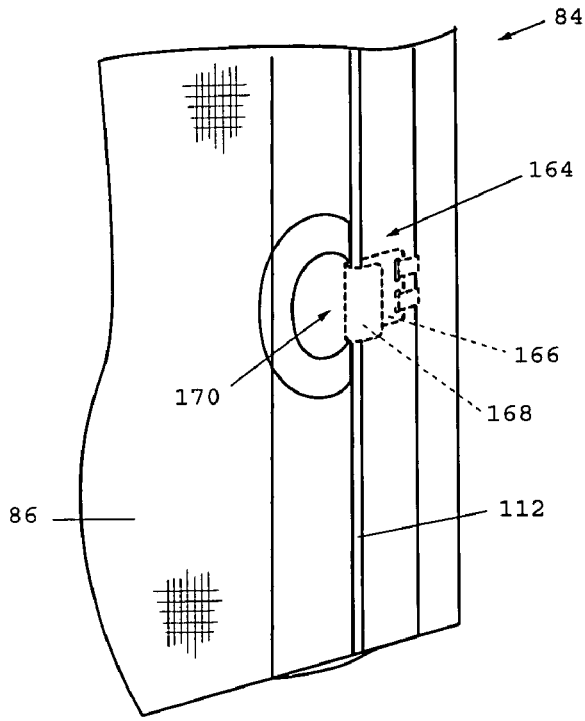
FIG. 15 is another fragmentary elevation view showing the fastener of FIG. 14 in an engaged position.

In an alternative embodiment depicted in FIG. 14, a fastener 164 suitable for securing the fan-shaped door 86 to the collapsible structure 84 may include a hook or clip member 166 configured to releasably secure to the third reinforcement member 112 of the door 86. The hook or clip member 166 may include a curved portion 168 disposed within the double-layered wall that is adapted to tightly grip the third reinforcement member 112 at or near a reinforced opening 170 formed through the fan-shaped door 86. To secure the fan-shaped door 86 to the collapsible structure 84, the user pulls the reinforced opening portion of the door 86 towards the hook or clip member 166 until the curved portion 168 engages the third reinforcement member 112, as shown in FIG. 15.

Figure 16:
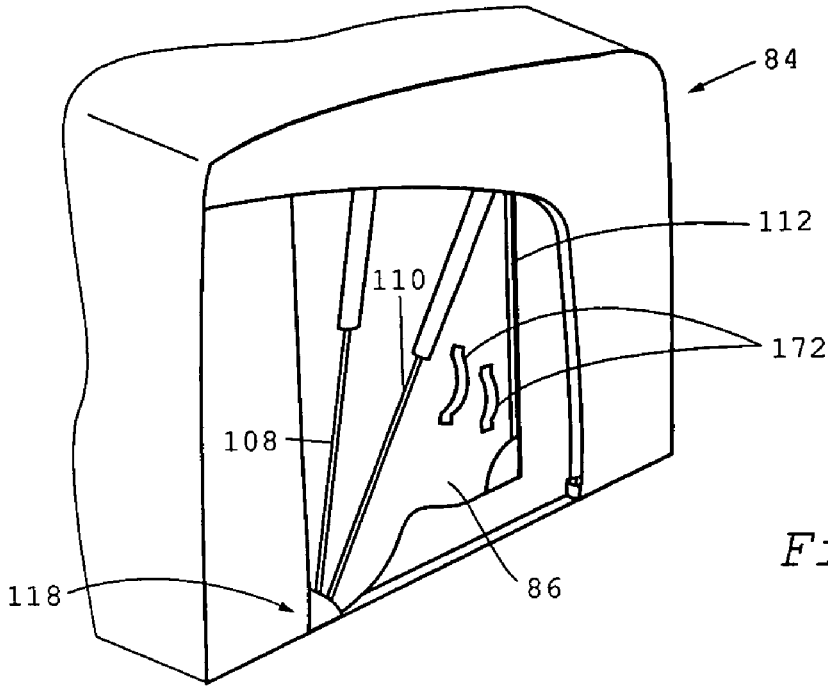
FIG. 16 is a fragmentary elevation view showing the door mechanism of FIG. 5 in a first position.
Figure 17:
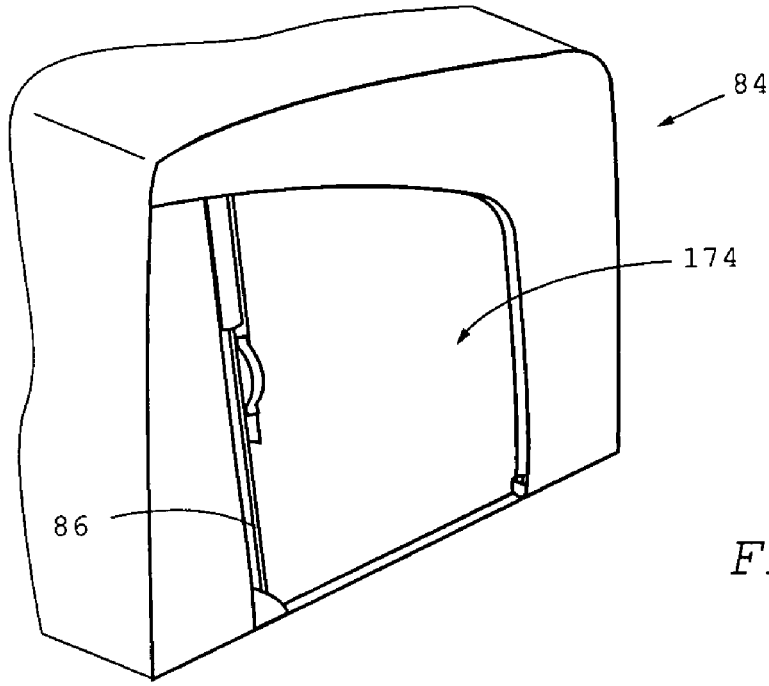
FIG. 17 is another fragmentary elevation view showing the door mechanism of FIG. 5 in a fully open position.

FIGS. 16-17 are fragmentary elevation views showing the operation of the fan-shaped door 86 between a closed position and an open position. To open the fan-shaped door 86 from an initially closed position (see FIG. 5), the user grips the third reinforcement member 112 or one or more optional handles 172 and moves the door 86 from right to left, causing the first and second reinforcement members 108, 110 to pivot about joint 118 and fan open, as shown in FIG. 16. Continued movement of the fan-shaped door 86 to the left causes the door 86 to fold upon itself, as shown in FIG. 17, permitting unobstructed passage through an arch-shaped opening 174. When placed into a fully open position, the fan-shaped door 86 is configured to rest at a slight angle past vertical, allowing the door 86 to remain in an open position under its own weight with gravity.

Closure of the fan-shaped door 86 can be accomplished by pulling the door 86 to the right a slight distance until the reinforcement members 108, 110, 112 are re-oriented to the right of vertical. Once advanced beyond vertical, the weight of the fan-shaped door 86 causes the door 86 to automatically fan shut to the closed position. The fan-shaped door 86 can then be secured to the collapsible structure 84 with, for example, fasteners 144, 154, or 164, as described above.

Figure 18:
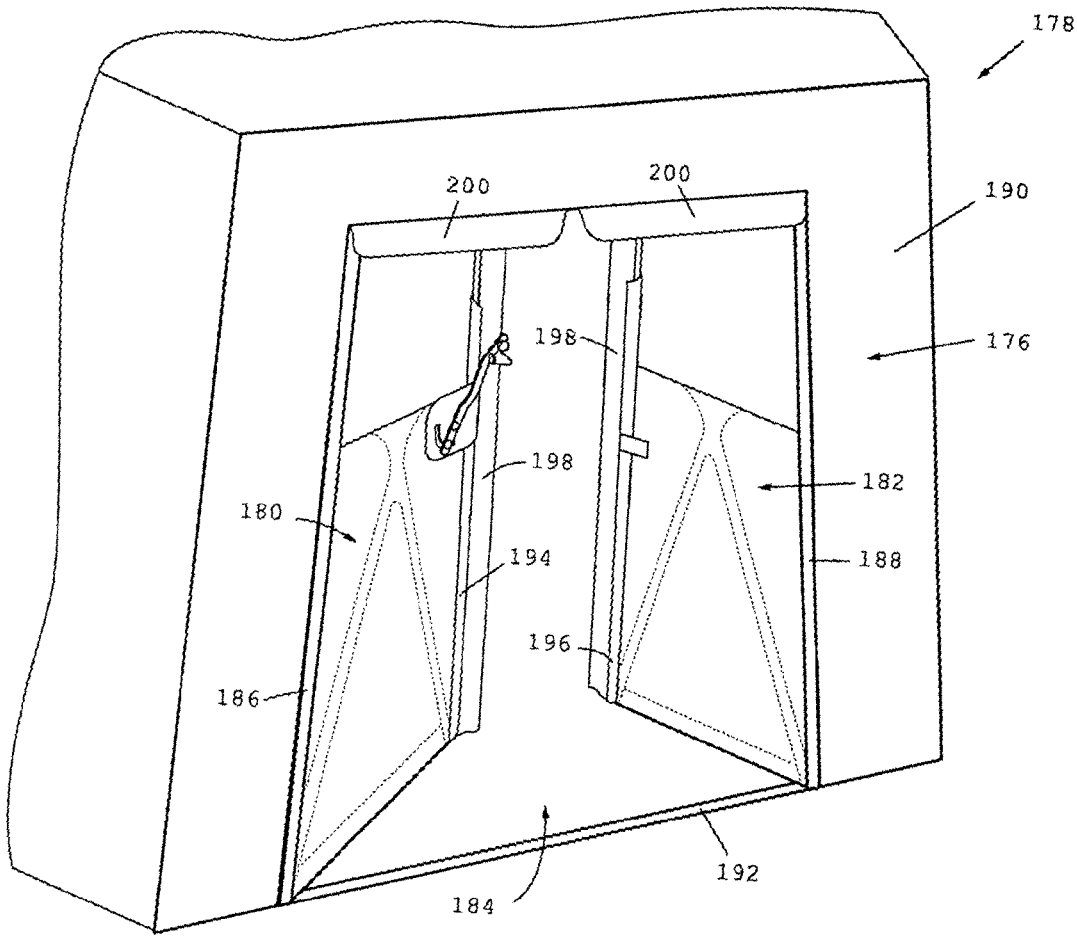
FIG. 18 is a fragmentary elevation view of another exemplary door mechanism for use with a collapsible structure.

FIG. 18 is a fragmentary elevation view of another exemplary door mechanism 176 for use with a collapsible structure 178 employing one or more swinging doors 180, 182. Door mechanism 176 comprises one or more swinging or café-style doors 180, 182 ergonomically designed to facilitate unobstructed passage through an entranceway 184 into the interior of the structure 178. The doors 180, 182 are hingedly connected at their respective far edges 186, 188 to the wall 190 in a manner that permits the doors 180, 182 to swing in either direction when pushed. The edges 186, 188 may be oriented at a slight angle away from vertical, causing the doors 180, 182 to swing upwardly and away from the ground a slight distance when opened. This vertical offset reduces the likelihood that the doors 180, 182 will catch on grass, rocks or other objects located on the ground, and provides momentum for the doors 180, 182 as they are closed.

The doors 180, 182 may extend vertically down towards the base or floor of the structure 178, obviating the need for a raised lip or lower doorway edge. A mesh strap 192 or other elongated member configured to lie flush with the ground or floor may span the lower portion of the entranceway 184, providing lateral support for the wall 190. The inner edge 194, 196 of each door 180, 182 may include a strip 198 adapted to create a seal between the doors 180, 182. In certain embodiments, the strips 198 may comprise a heavy duty Nylon material such as pack cloth or Cordura®, which has a greater stiffness than the fabric used in the construction of the doors 180, 182. The strips 198 may also comprise a suitable plastic material in some embodiments. One or more strips 200 may also be placed on the top and bottom edges (see FIG. 19) of the entranceway 184 to create a seal between the doors 180, 182 and the wall 190. The strips 198, 200 are configured to provide a seal against wind, moisture or other elements without affecting the movement of the doors 180, 182 within the entranceway 184.

Figure 19:
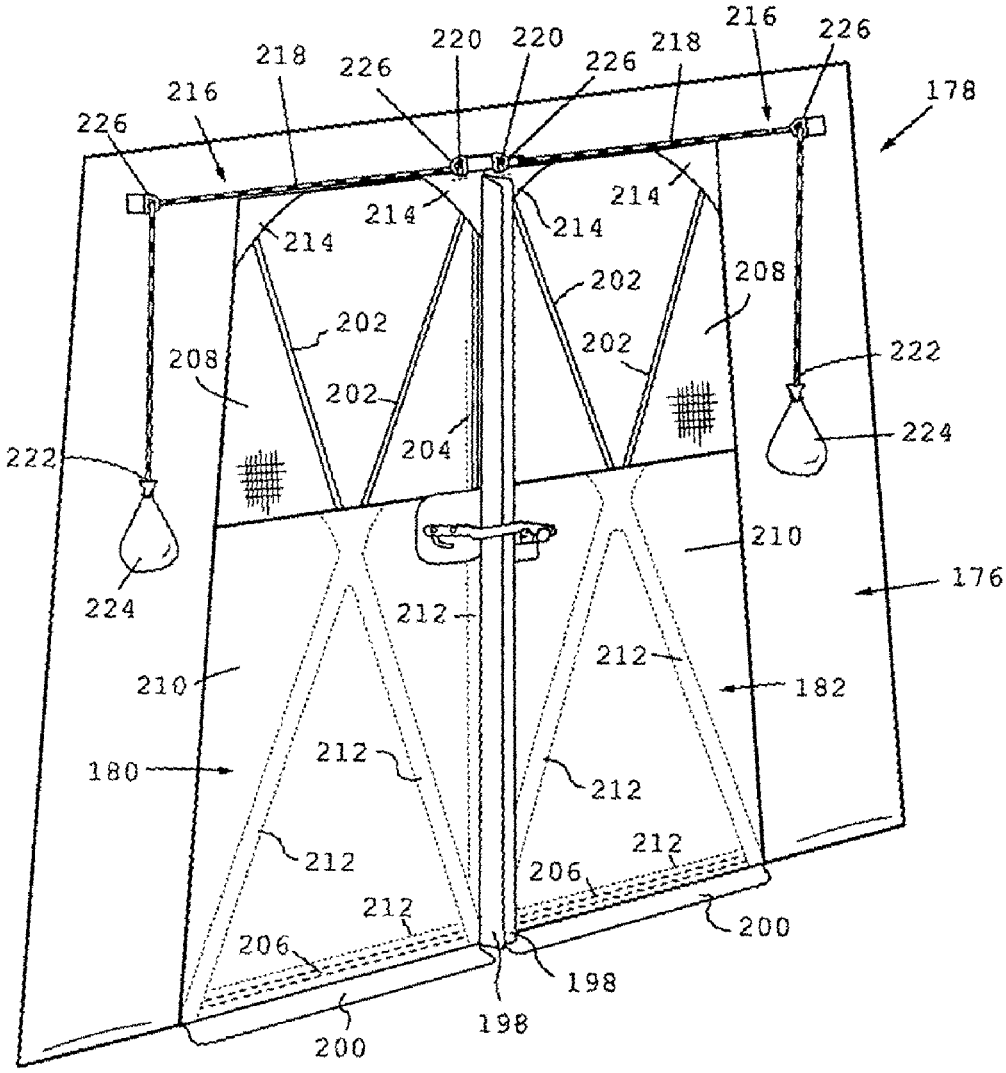
FIG. 19 is a fragmentary elevation view showing the door mechanism of FIG. 18 in a closed position from a vantage point within the interior of the collapsible structure.

FIG. 19 is a fragmentary elevation view showing the door mechanism 176 in a closed position from a vantage point within the interior of the collapsible structure 178. As shown in FIG. 19, each door 180, 182 may include a number of cross reinforcement members 202, vertical reinforcement members 204, and lateral reinforcement members 206 sandwiched between two layers 208, 210 of fabric or textile material (e.g. Nylon). A portion of one of the layers (e.g. layer 210) can be removed to allow the reinforcement members 202, 204, 206 to be inserted through several sleeves 212 sewn into one or both of the layers 208, 210. Once inserted into the sleeves 212, a number of pockets 214 disposed about the corners of each door 180, 182 may be used to firmly secure the cross and vertical reinforcement members 202, 204 thereto.

Figure 20:
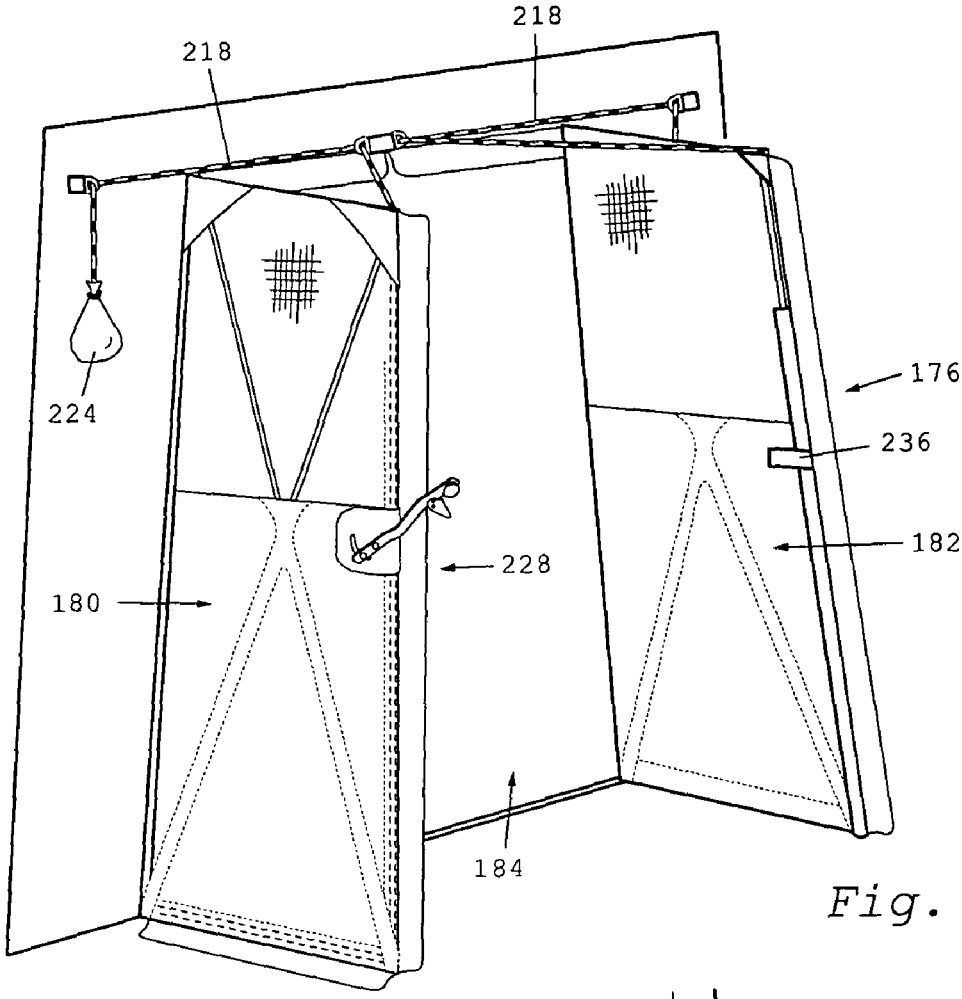
FIG. 20 is another fragmentary elevation view showing the door mechanism of FIG. 18 in an open position from a vantage point within the interior of the collapsible structure.

The door mechanism 176 may further include one or more closure mechanisms 216 configured to automatically close each of the doors 180, 182. Each closure mechanism 216 may include a flexible cable or cord 218 having a first end 220 attached to the top, inner edge of the door 180, 182, and a second end 222 operatively coupled to a counterweight 224 (e.g. a sandbag). The flexible cable or cord 218 may be threaded through a number of eyelets or pulleys 226 that allow the counterweight to pull the doors 180, 182 shut in the absence of a sufficient force applied thereto. As can be seen in FIG. 20, when the doors 180, 182 are forced open, the tension in the flexible cable or cord 218 causes the counterbalance 224 to move upwardly, allowing the doors 180, 182 to swing open to permit unobstructed passage through the entranceway 184.

Figure 21:
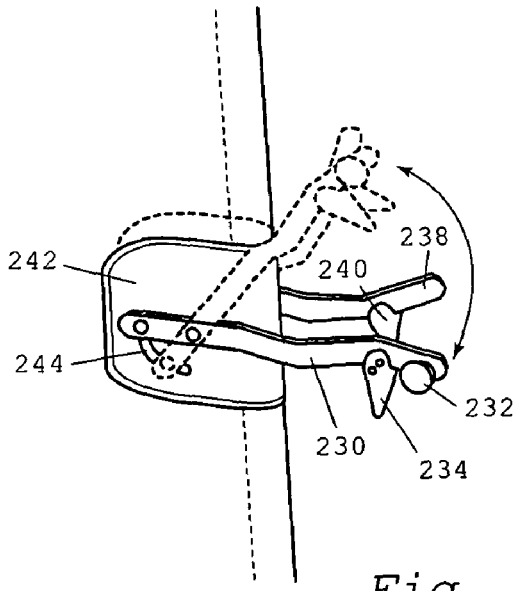
FIG. 21 is an exploded fragmentary elevation view showing a locking mechanism in accordance with an exemplary embodiment of the present invention.

In certain embodiments, the door mechanism 176 may include a fastener 228 that can be used to secure the doors 180, 182 together. As shown in greater detail in FIG. 21, the fastener 228 may comprise a first latch arm 230 that can be rotated via a handle 232 to engage a first latch 234 into a catch 236 (see FIG. 20) located on the opposite door. A second latch arm 238, latch 240, and handle (not shown) positioned on the opposite face of the door may be used to engage a corresponding catch located on the opposite door. The first and second latch arms 230, 238 may be rotatably coupled to a plate 242 equipped with a curved slot 244. In use, the curved slot 244 acts to constrain or limit the travel of the latch arms 230, 238, as indicated by the arrow in FIG. 21.

Figure 22:
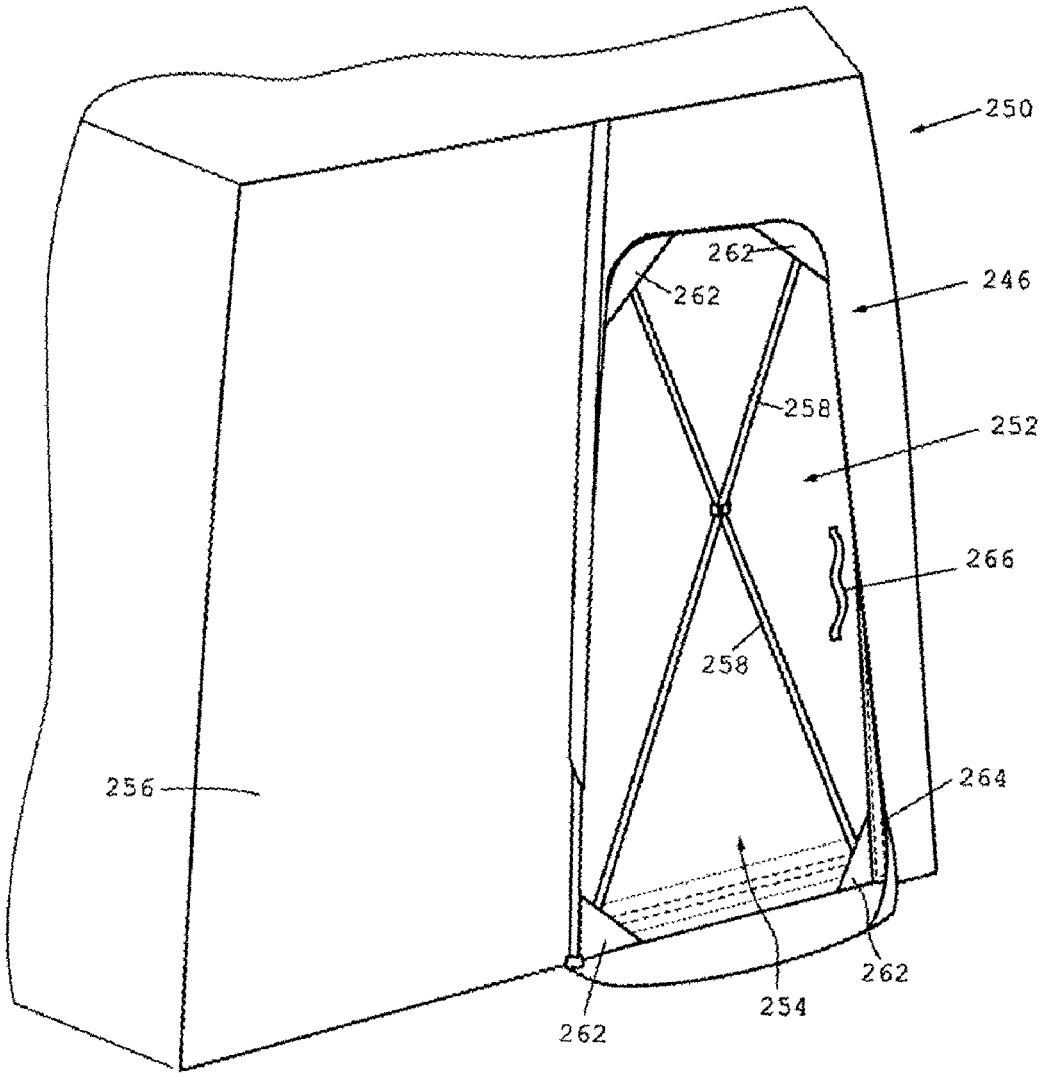
FIG. 22 is a fragmentary elevation view of another exemplary door mechanism for use with a collapsible structure.

FIG. 22 is a fragmentary elevation view of another exemplary door mechanism 246 for use with a collapsible structure 250 employing a sliding door 252. As with other embodiments described herein, the sliding door 252 may be ergonomically designed to permit simplified and unobstructed passage through an entranceway 254 of the collapsible structure 250. The sliding door 252 is configured to slide back and forth between an open position and a closed position within a double-layered wall 256 of the structure 250. The sliding door 252 may extend vertically to the base or floor of the structure 250, obviating the need for a raised lip or lower doorway edge.

The door mechanism 246 may be formed from one or more layers of fabric material (e.g. Nylon) supported by one or more cross reinforcement members 258 and lateral reinforcement members 260. The reinforcement members 258, 260 may be held in place adjacent to the fabric material via a number of pockets 262 disposed about the corners of the sliding door 252. A vertical reinforcement member 264 located on the leading edge of the sliding door 252 further supports the sliding door 252 in an upright position within the entranceway 254. A second vertical reinforcement member (not shown) located on the trailing edge of the sliding door 252 may also be employed, if desired, to further support the door 252 in an upright position. A handle 266 located on each face of the sliding door 252 may be used to open or close the door 252 from a position either within or outside of the collapsible structure 250. In certain embodiments, the door mechanism 252 may be configured to detach from the collapsible structure 250 to facilitate disassembly, or to permit use of the structure 250 without a door.

Figure 23:
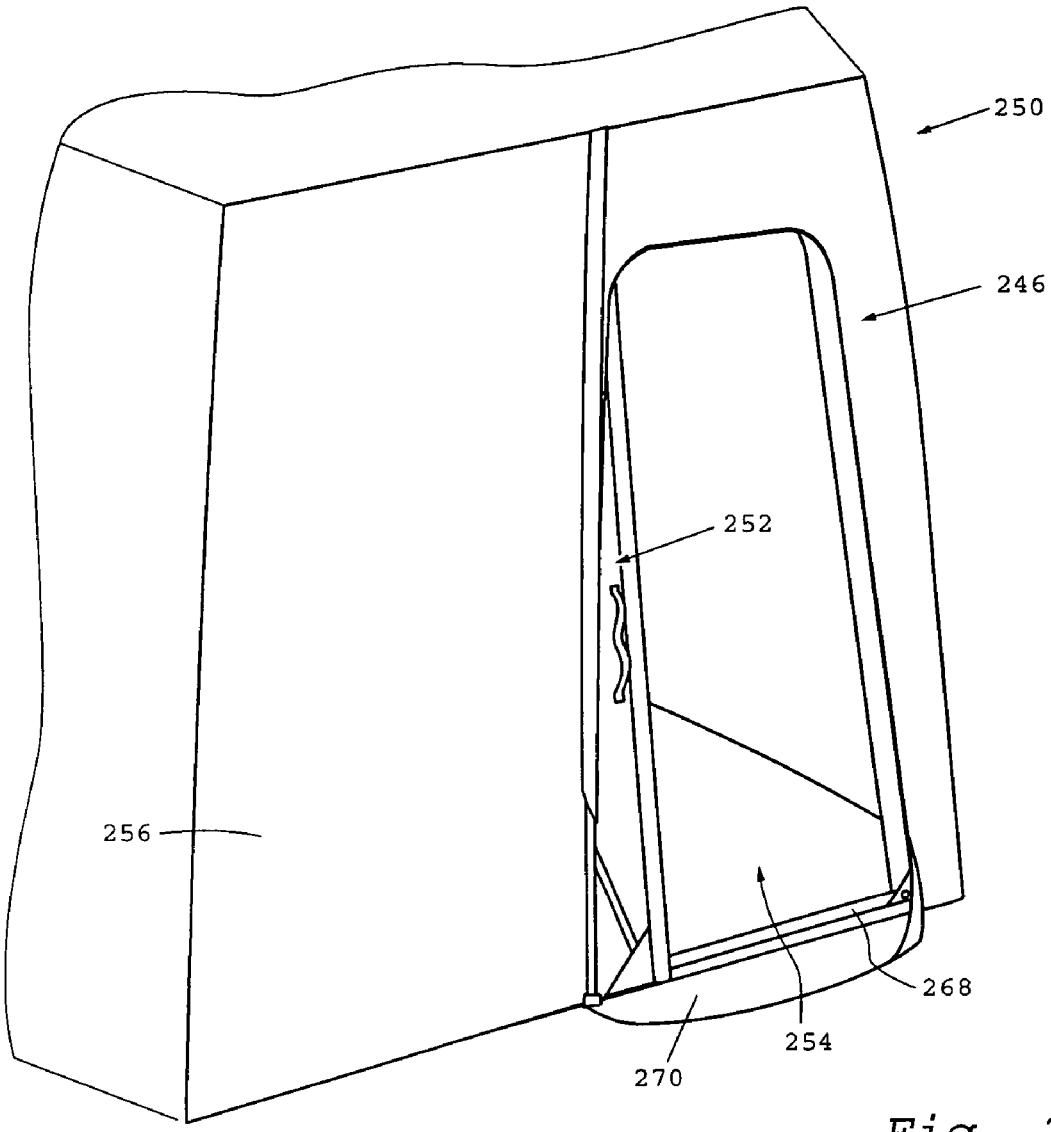
FIG. 23 is another fragmentary elevation view showing the door mechanism of FIG. 22 in an open position.

FIG. 23 is another fragmentary elevation view showing the door mechanism 246 of FIG. 22 in an open position. As shown in FIG. 23, the door mechanism 246 retracts within the space between the double-layered wall 256 of the structure 250 to permit unobstructed passage through the entranceway 254. The door mechanism 246 may be configured to slide along a mesh strap 268 or other guiding member that extends laterally across the bottom portion of the entranceway 254. An optional threshold 270 located along the bottom portion of the entranceway 254 and in front of the sliding door 252 may also be used to guide the door 252 as it is moved from an open position to a closed position. The mesh strap 268 and/or threshold 270 may be configured to lie flush with the ground to prevent interference with the wheels or feet of a mobility device passing through the entranceway 254.

Figure 24:
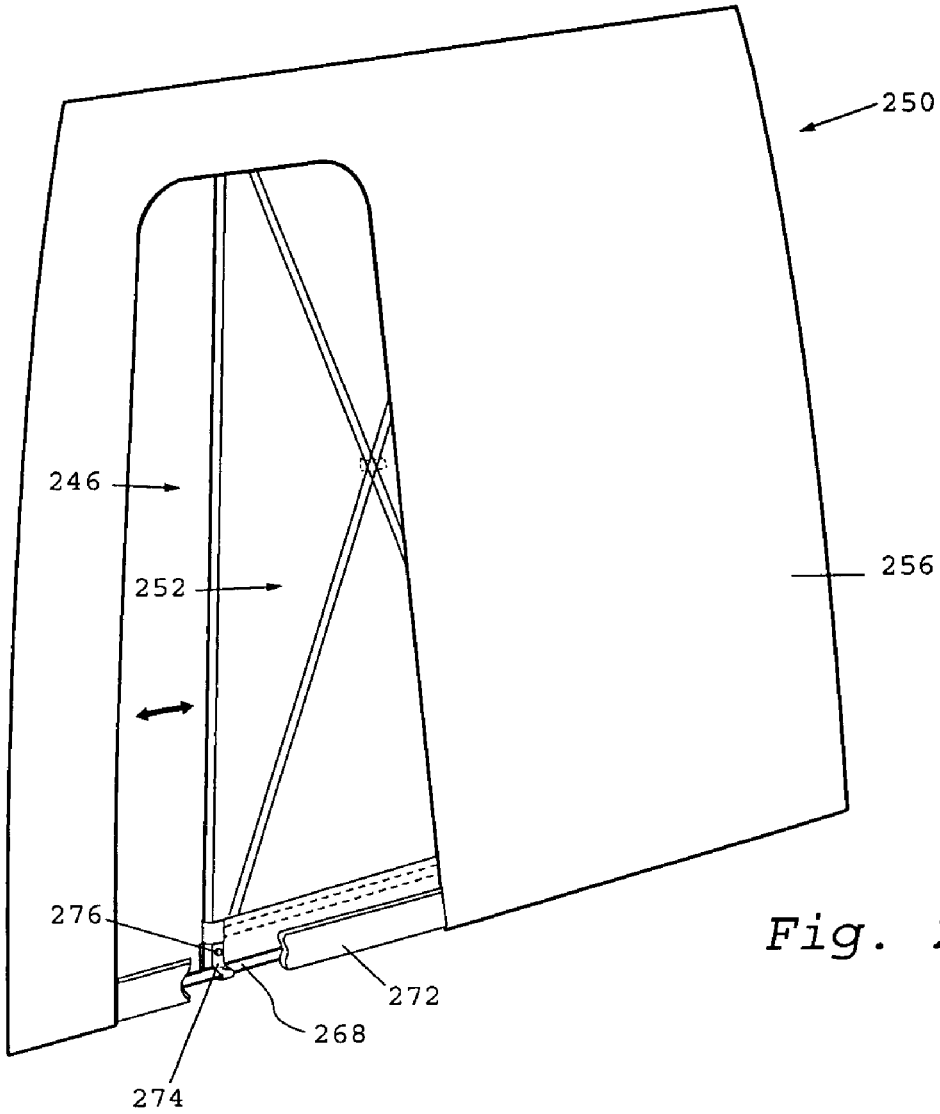
FIG. 24 is another fragmentary elevation view showing the door mechanism of FIG. 22 in a slight open position from a vantage point within the interior of the collapsible structure.

FIG. 24 is another fragmentary elevation view showing the door mechanism 246 of FIG. 22 in a slight open position from a vantage point within the interior of the collapsible structure 250. As indicated by the arrow in FIG. 24, the sliding door 252 is configured to slide along the mesh strap 268 in a plane substantially parallel to the wall 254. A second, larger mesh strap 272 disposed adjacent the smaller mesh strap 268 may be employed to prevent the sliding door 252 from moving in a direction towards the interior of the collapsible structure 250, and acts as a seal to prevent elements such as moisture and wind from entering the collapsible structure 250. The larger mesh strap 272, which is shown broken in FIG. 24 for sake of clarity, extends along the bottom portion of the entranceway 254, and is oriented with its thickness in a vertical plane.

Figure 25:
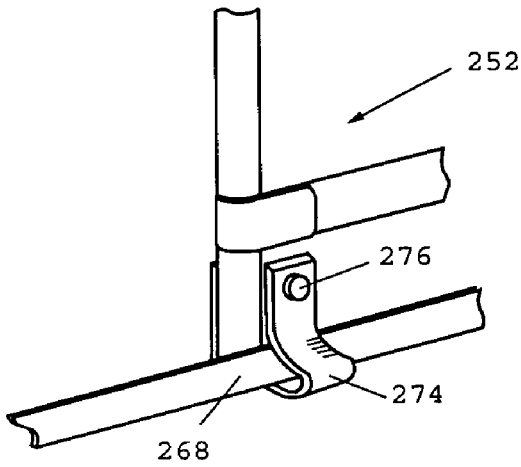
FIG. 25 is an exploded fragmentary elevation view showing the attachment of the door mechanism to the collapsible structure.

FIG. 25 is an exploded fragmentary elevation view showing the attachment of the sliding door 252 to the mesh strap 268. As illustrated in FIG. 25 with the second mesh strap 272 shown removed for clarity, a retaining strap 274 equipped with a snap fitting 276 or other suitable fastener may be used to releasably secure the sliding door 252 to the mesh strap 268. In use, the retaining strap 274 provides a guide for the sliding door 252, which can be subsequently detached to permit removal of the door 252 from the collapsible structure 250.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes may be made in details, particularly in matters of shape, size, and arrangement of parts without exceeding the scope of the invention.

What is claimed is:

1. A collapsible structure including a door mechanism, comprising:

a collapsible structure including an entranceway formed in a wall of the collapsible structure; and a fan-shaped door including a flexible sheet of material configured to extend across the entranceway of the collapsible structure and being configured to move between an open position and a closed position with curvilinear motion, the fan-shaped door connected to the collapsible structure at an attachment point;

the fan-shaped door so characterized in that movement of the fan-shaped door between the open position and the closed position includes radial movement of the fan-shaped door pivoting about the attachment point;

a first reinforcement member coupled to the fan-shaped door, the first reinforcement member extending across the flexible sheet of material from the attachment point;

a second reinforcement member coupled to the fan-shaped door, the second reinforcement member extending across the flexible sheet of material from the attachment point wherein the first reinforcement member and the second reinforcement member radiate outward from the attachment point at an angle to one another; and wherein the collapsible structure includes a double-layered wall including a first layer of material and a second layer of material, wherein the fan-shaped door is positioned between the first layer of material and the second layer of material of the double-layered wall.

2. The collapsible structure of claim 1 wherein the double-layered wall is flexible.

3. The collapsible structure of claim 1 wherein the first layer and the second layer are fabric.

4. The collapsible structure of claim 1 wherein the collapsible structure is a tent.

* * * * *

UNITED STATES PATENT AND TRADEMARK OFFICE

CERTIFICATE OF CORRECTION

PATENT NO. : 7,588,045 B2
APPLICATION NO. : 10/643333
DATED : September 15, 2009
INVENTOR(S) : Goodwin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1069 days.

Signed and Sealed this

Twenty-first Day of September, 2010

David J. Kappos

David J. Kappos
*Director of the United States Patent and Trademark Office*